US005807138A

United States Patent [19]

Guiol

[11] Patent Number: 5,807,138

[45] Date of Patent: Sep. 15, 1998

[54] END HOUSING FOR A PLUG-IN CONNECTOR

[76] Inventor: Eric Guiol, Weidenweg 6a, D-83620 Feldkirchen-Westerham, Germany

[21] Appl. No.: 598,525

[22] Filed: Feb. 8, 1996

[51] Int. Cl.[6] ..... H01R 13/648

[52] U.S. Cl. ..... 439/610

[58] Field of Search ..... 439/95, 92, 98, 439/607, 610, 445, 447, 545, 901, 578, 579, 580, 583, 584

[56] References Cited

U.S. PATENT DOCUMENTS

| | | | |
|---|---|---|---|
| 4,583,809 | 4/1986 | Werth et al. | 439/610 |
| 4,671,598 | 6/1987 | Keehne | 439/610 |
| 4,963,104 | 10/1990 | Dickie | 439/610 |
| 5,052,947 | 10/1991 | Brodie et al. | 439/610 |
| 5,310,361 | 5/1994 | Muchowicz et al. | 439/610 |

FOREIGN PATENT DOCUMENTS

| | | |
|---|---|---|
| C-4013963 | 10/1991 | Germany . |
| 4013963 | 7/1993 | Germany . |

*Primary Examiner*—Hien Vu

[57] ABSTRACT

An end housing for a plug-in connector is provided having an outer housing and a discrete toothed rim. The discrete toothed rim can be loosened from the outer housing. According to one embodiment of the present invention, the toothed rim may be defined by at least two parts. The toothed rim may screwthreadably engage the outer housing. The end housing is useful with a plug-in connector for connection to a cable or to a cable bundle.

6 Claims, 6 Drawing Sheets

END HOUSING FOR A PLUG-IN CONNECTOR

FIELD OF THE INVENTION

The present invention generally relates to the field of electrical cable interconnection. More particularly, the present invention concerns an end housing for a plug-in connector. The end housing has an outer housing and a discrete toothed rim.

BACKGROUND OF THE INVENTION

Known end housings for use with plug-in type electrical connectors employ toothed rims which are made integral with an external housing. Such end housing constructions present limitations in some applications because the diameter of an associated cable to be connected, and the diameter of a respective cable sleeve, are limited by the diameter of the toothed rim. Although an adapter may be employed to accommodate such limitations, the total weight of a plug-in connector which incorporates an adapter will be greater, which is not desirable in weight critical applications.

It is apparent that it would be advantageous to provide an improved cable connector system directed to overcoming the limitations of the prior art. Accordingly, a suitable alternative is provided including features more fully disclosed hereinafter.

SUMMARY OF THE INVENTION

The present invention advances the art of electrical connectors beyond which is known to date. The present invention relates to an end housing for a plug-in type electrical connector having an outer housing and a discrete toothed rim. The discrete toothed rim may be loosened from the outer housing. According to one embodiment of the present invention, the discrete toothed rim comprises at least two parts. The discrete toothed rim may include an outside threading which engages respective inside threading of the outer housing. Therefore, the discrete toothed rim may be screwthreadably mounted to the outer housing.

The end housing of the present invention finds application with a plug-in type connector for connection with an electrical cable, or with an electrical cable bundle.

Therefore, it is a purpose of the present invention to provide an improved end housing, for use with a plug-in connector, having a discrete toothed rim that is detachable from an end housing element.

It is another purpose of the present invention to provide an improved end housing, for use with a plug-in connector, that offers advantages in weight critical applications.

It is another purpose of the present invention to provide an improved end housing, for use with a plug-in connector, that can accept large diameter cables without the use of an adapter ring.

It is another purpose of the present invention to provide an improved end housing, for use with a plug-in connector, that is easier to produce than housings formed with an integral toothed rim portion.

BRIEF DESCRIPTION OF THE DRAWINGS

The foregoing summary, as well as the following detailed description of a preferred embodiment of the present invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
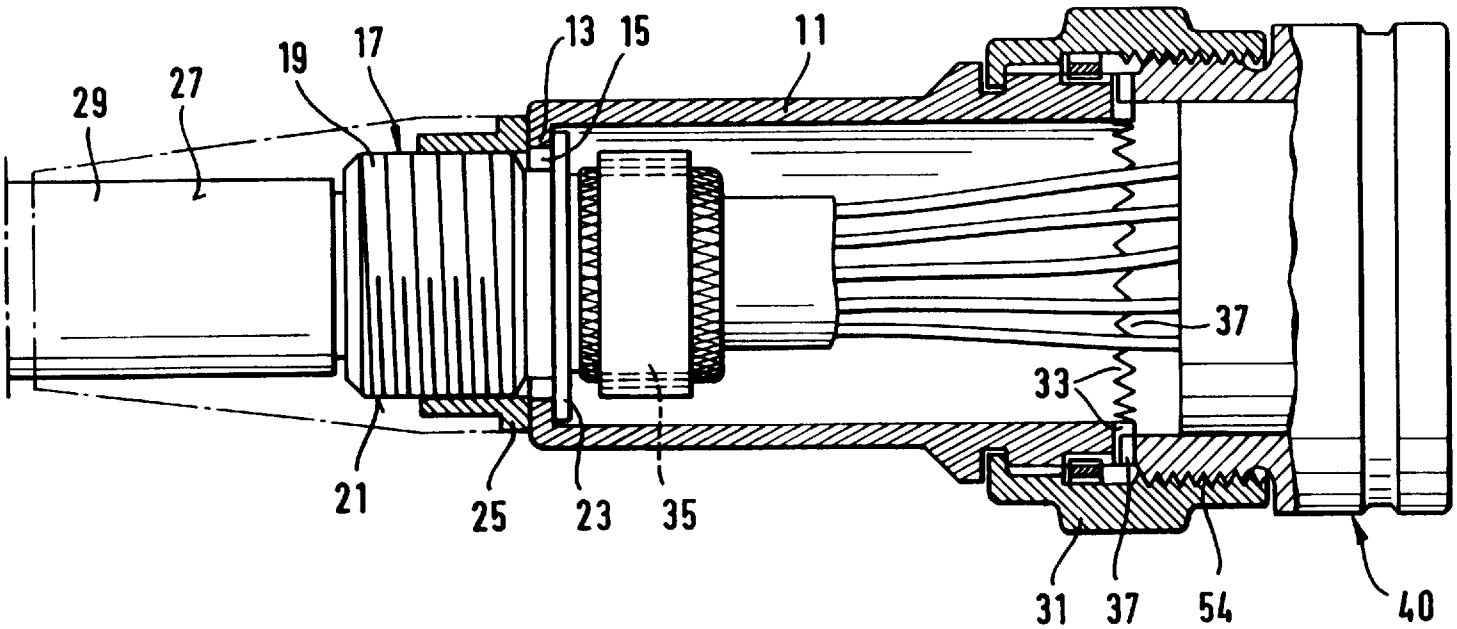
Fig. 1 (Prior Art)
FIG. 1 shows an end housing according to the prior art.

Referring now to the drawings, wherein similar reference characters designate corresponding parts throughout the several views, the present invention is best understood by reference to FIGS. 3 through FIG. 6.

FIG. 1 illustrates a prior art end housing obtained from Filcon Elektronik Vertriebsgesellschaft fur Bauelemente und Gerate mbH, located in Taufkirchen, Germany. Such an end housing, which is sold under the tradename PARATRON, incorporates an end housing assembly which comprises a metal outer housing 11, having a front wall 13 in which a passage opening 15 is formed. This passage opening 15 defines a cable insertion side of the end housing. A sleeve 17 has an outer portion 19, having disposed thereon sleeve threading 21 protruding from the outer housing 11, and a radial flange 23 which is adapted to lie on the front wall 13. The sleeve 17 is situated in the passage opening 15. A threaded nut 25 screws onto the sleeve threading 21, thereby mechanically fastening the front wall 13 and the flange 23. An outer insulation sheath 27, of an electrical cable 29, is connected to the end of sleeve 17, which protrudes from the outer housing 11.

The prior art end housing of FIG. 1 is intended for use in a plug-in connector 40 in which the cable 29 is provided with a shield (not shown). In order to connect such a cable 29 to the plug-in connector, a piece of the outer insulation sheath 27, of cable 29, is stripped to expose the shielding. Thereafter, the sleeve 17 is pushed onto the exposed shield. The sleeve 17 has a lead-through opening that is adapted to the outside diameter of the shield so that the sleeve can be pushed directly onto the shield of cable 29. The sleeve 17 has a sleeve continuation 35. After the sleeve 17 has been properly positioned, the exposed shield of the cable 29 can be enclosed by the sleeve continuation 35. The design of this type of plug-in connector is fully described in German Patent DE-C-40 13 963.

The prior art housing additionally has within the outer housing 11 a toothed rim 33. The toothed rim 33 is constructed in such a manner that it is adapted to a toothed rim 37 of the plug-in connector. The teeth of the respective toothed rims 33 and 37 match each other after the plug-in connector 40 is screwed into the outer housing 11 such that the plug-in connector 40 cannot be rotated with respect to the outer housing 11.

Figure 2A:
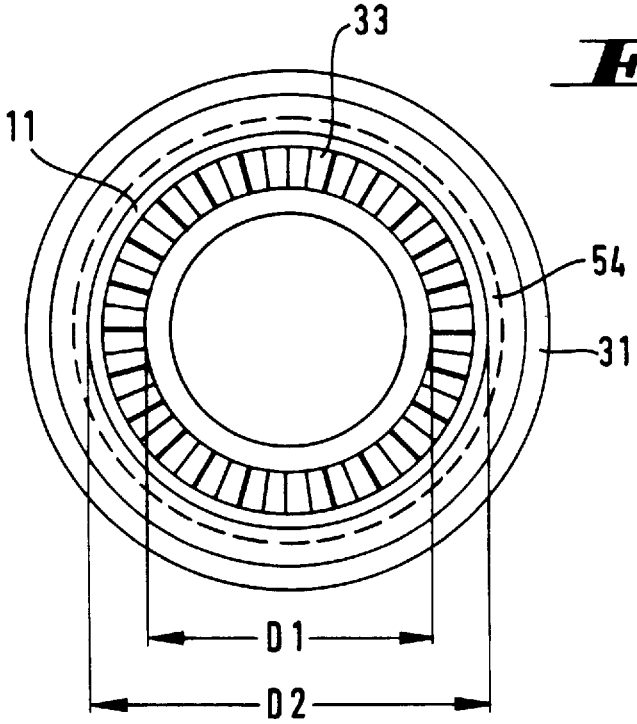
Fig. 2A (Prior Art)
FIGS. 2A and 2B show simplified illustrations of an end housing to clarify shortcomings associated with prior art end housings.
Figure 2B:
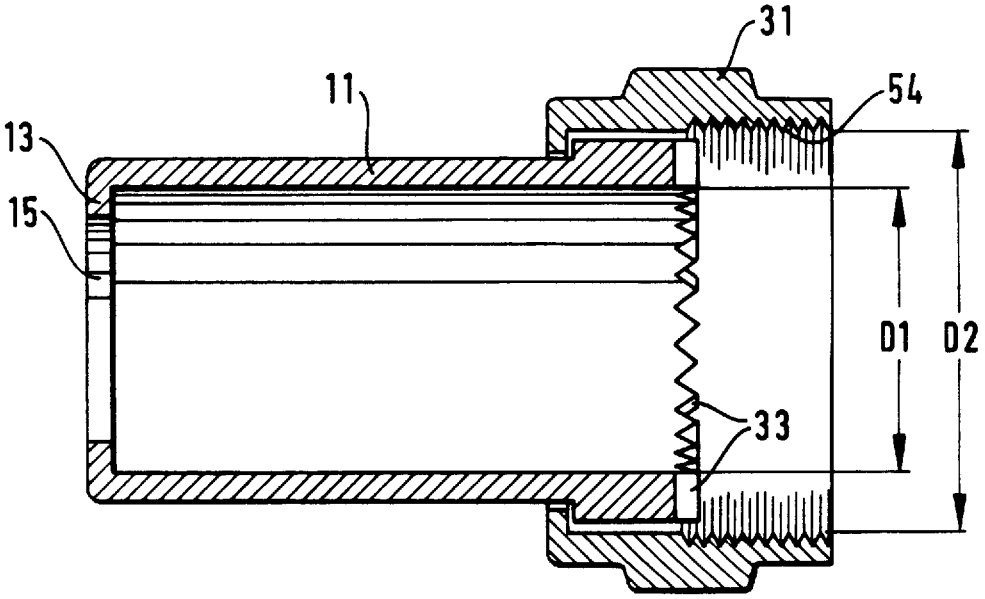
Fig. 2B (Prior Art)

A shortcoming of the above described prior art plug-in connector is that the diameter of the cable 29 and the diameter of the sleeve 17 are limited by the diameter of the toothed rim 33. This shortcoming is best understood by reference to FIGS. 2A and 2B. FIG. 2A is a simplified top view of the end housing 11. FIG. 2B is a simplified longitudinal view of the outer housing 11. In both FIGS. 2A and 2B, the opening in the toothed rim 33 has a diameter D1 that is smaller than a diameter D2 of threading 54 for the plug-in connector 40. For example, in some prior art plug-in connectors, the toothed rim 33 can have an inside diameter of 9 mm, whereas the threading 54 has a diameter of 13 mm. Such a shortcoming may be overcome by using an adapter ring 31 in order to adapt the plug-in connector 40 to a larger end housing. However, such adapter rings increase the total weight of the associated plug-in connector, which is disadvantageous in weight-critical applications.

Figure 3:
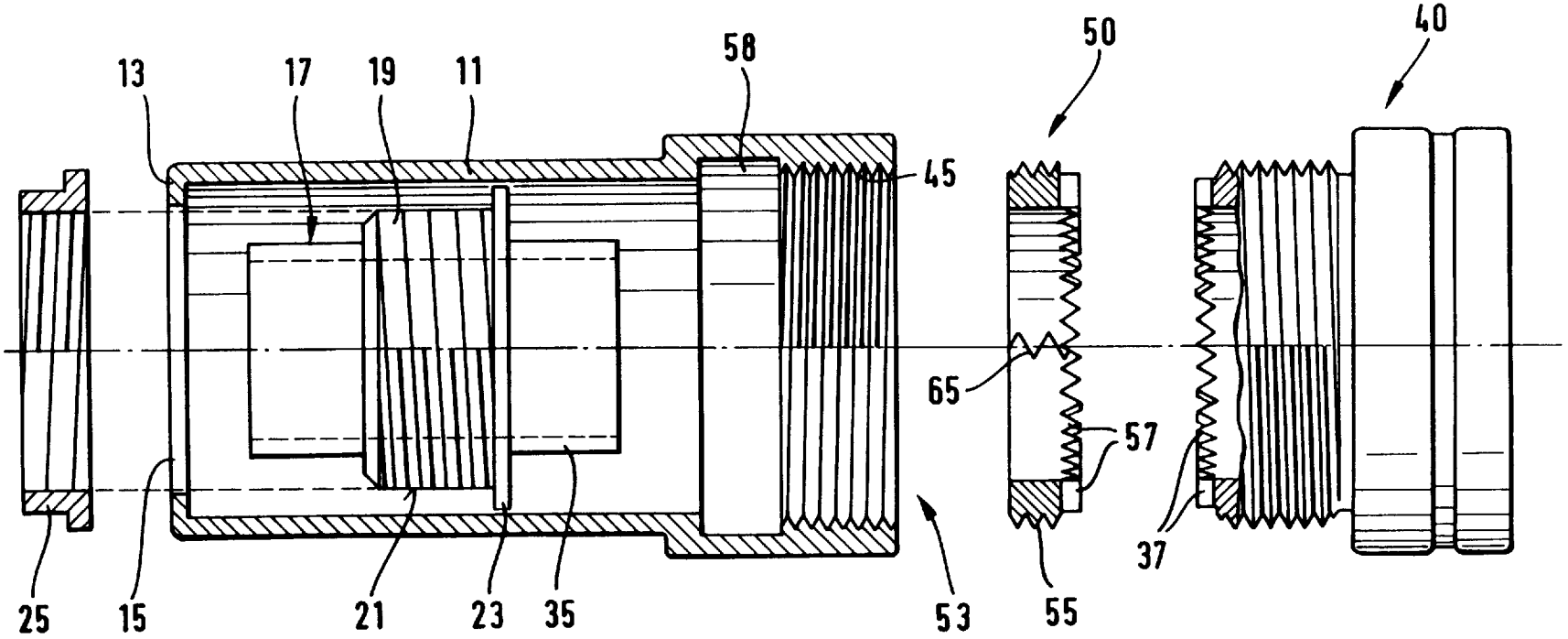
FIG. 3 shows an end housing according to one embodiment of the present invention.

FIG. 3 shows an end housing according to one embodiment of the present invention. The end housing comprises an outer housing 11 having a front wall 13 in which a passage opening 15 is formed. This passage opening 15 defines the cable insertion side of the end housing. A sleeve 17 has a radial flange 23, a sleeve continuation 35 and an outer part 19 having sleeve threading 21 formed thereon. The sleeve continuation 35, disposed within outer housing 11 in an assembled position, is adapted to accept an exposed shield of a cable (not shown). A threaded nut screws onto the sleeve threading 21 mechanically fastening the front wall 13 and the flange 23. An outer insulation sheath 27 of an electrical cable 29 is connected to the end of sleeve 17 protruding from outer housing 11.

Opposite the passage opening 15 is a second passage opening 43. The outer housing 11 has inside threading 45 on the second passage opening 43. The inside threading 45 is adapted to accept a plug-in connector (not shown) and to accept a threaded toothed rim 50. The toothed rim 50, preferably cylindrical in shape, has outside threading 55 adapted to the inside threading 45 of the outer housing 11. Teeth 57 of toothed rim 50 are adapted to engage the teeth 37 of a plug-in connector.

In an alternate embodiment of the present invention, the toothed rim 50 may be fastened to the outer housing 11 by an adhesive rather than by outside threading 55. Also the toothed rim 50 may be fastened by means of a clamping or hook device, or a tension ring in outer housing 11. A preferred adhesive is a conductive adhesive, such as a conductive screw-locking varnish.

Figure 4A:
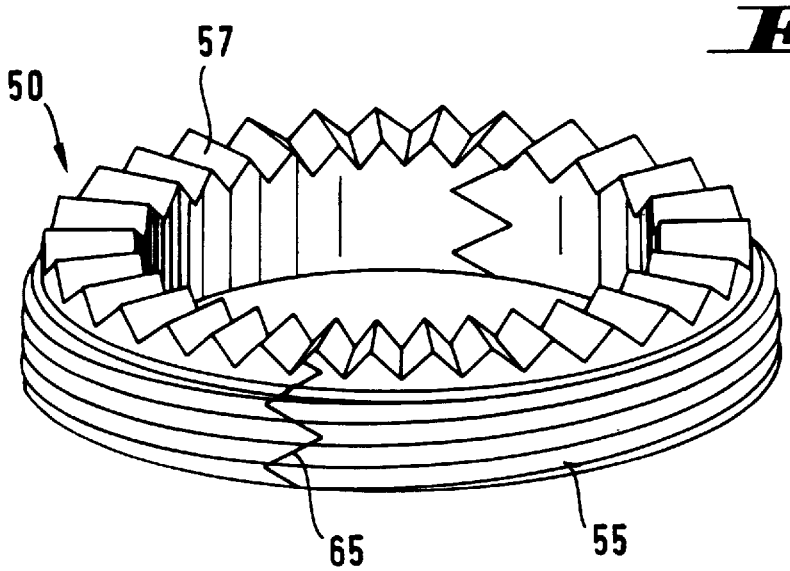
FIGS. 4A and 4B show a toothed rim according to an alternate embodiment of the present invention.
Figure 4B:
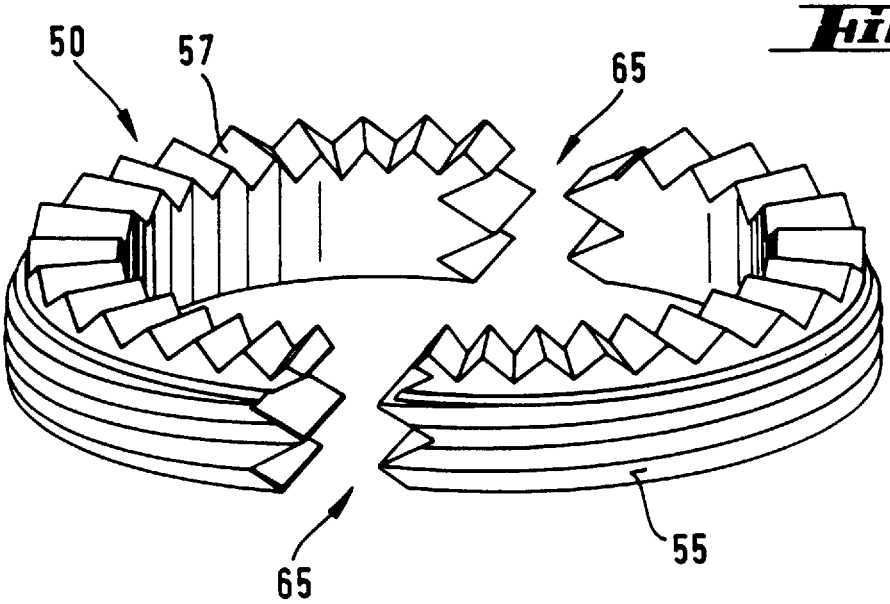

In an another embodiment of the present invention, the toothed rim 50 is formed from two or more parts, as shown in FIGS. 4A and 4B. The toothed rim 50 can be loosened into two parts by a cut 65. To introduce the toothed rim within the outer housing the toothed rim preferably has a threading adapted to the inside threading of the outer housing. This threading permits the toothed rim to be screwed into the end housing. A multiple part toothed rim construction facilitates more simple disposal about a cable 29 protruding from opening 43 and simplifies mounting of the toothed rim in the end housing.

After toothed rim 50 is screwed into the outer housing 11, the multiple parts of toothed rim 50 are held together without additional means. Alternatively, a clamping or hook device, adhesive, or conductive screw-locking varnish can be used in order to assemble the parts of toothed rim 50.

Figure 5:
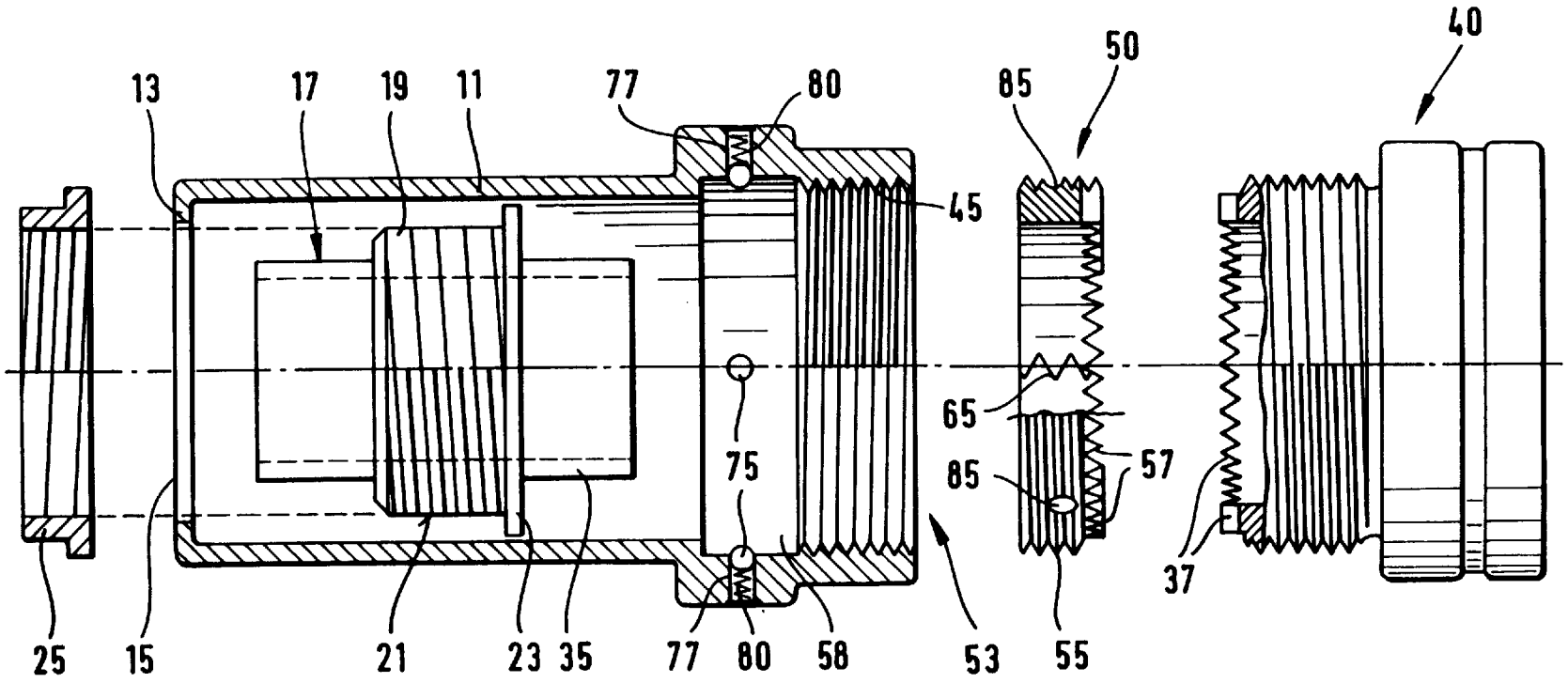
FIG. 5 shows yet another alternate embodiment of the present invention.

As best seen by reference to FIG. 3, the present invention comprises an outer housing 11 which defines a recess 58 that serves to accept a discrete toothed rim generally illustrated at 50. Additionally, the recess 58 may be extended, as is shown in FIG. 5, wherein the outer housing 11 defines lengthened apertures 77 in the recess. In the embodiment of the present invention illustrated in FIG. 5, balls 75 are situated in apertures 77 on an open end of such apertures. A spring 80 is arranged within hole 77 between the end wall of the hole and a ball 75.

Figure 6:
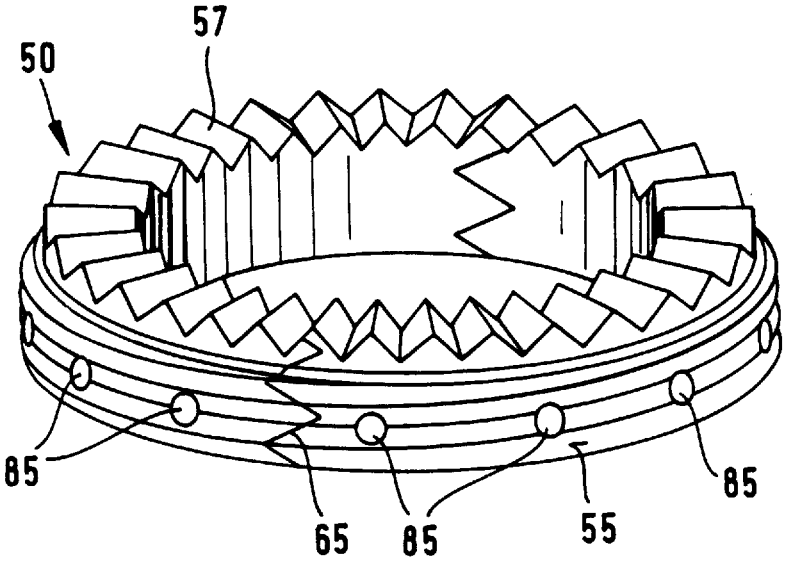
FIG. 6 shows a toothed rim according to another alternate embodiment of the present invention.

As best seen by reference to FIG. 6, the toothed rim 50 may contain cavities 85, in the outside threading 55, that are designed to accommodate the balls 75. As the toothed rim 50 is screwed into outer housing 11, the balls 75 are forced into cavities 85 by the springs 80. The balls 75 secure the toothed rim 50 in outer housing 11. Such a design may be particularly useful in operational environments which suffer extreme vibration forces, such as but not limited to a helicopter.

The end housing of the present invention may be comprised of a plastic material, or an electrically conducting plastic material. If a non-conducting plastic construction is employed, the outer housing 11 is preferably coated with a thin metal layer to ensure electrical connection between the shield of cable 29 and the plug-in connector. A plastic construction reduces the weight of the end housing.

The end housing of the present invention addresses the shortcomings of the prior art assemblies by providing a discrete toothed rim which may be separated from the outer housing 11. Since the end housing of the present invention can accept cables with a larger diameter, an adapter ring is not needed and weight is not added. The manufacture of such end housings is also simplified because the toothed rim is no longer produced together with the outer housing in the same metal piece. The toothed rim can be produced in a separate process, thereby providing an advantage over the prior art assemblies because of the complicated design of the toothed rim.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

I claim:

1. An improved end housing for use with a plug-in connector, the end housing including an outer housing having a front wall in which a first passage opening is formed leading to an outer housing passage within said outer housing, said first passage opening defining a cable insertion side of the end housing, wherein a second passage opening is formed in said outer housing at an end opposite the first passage opening and leads to said outer housing passage and said end housing including a sleeve adapted to accept a cable removably present with said outer housing passage, said improvement comprising:

a discrete toothed rim adapted to be received by the second passage opening of the outer housing and inserted within said outer housing passage, said discrete toothed rim being removable from the outer housing passage and being lockingly engageable with a plurality of teeth of the plug-in connector, wherein said outer housing has an inside threading and said toothed rim has an outside threading adapted to screwthreadably engage said inside threading and wherein said toothed rim has teeth at one end thereof.

2. The invention of claim 1, wherein said toothed rim comprises at least two parts adapted to be assembled.

3. The invention of claim 1, wherein said toothed rim has an outer surface defining at least one cavity;

wherein said outer housing defines at least one recess;

wherein a ball and a spring are disposed within said at least one recess, said spring being disposed between said ball and said outer housing defining said recess; and wherein said at least one cavity is adapted to capture said ball.

4. The invention of claim 1, wherein said end housing is comprised of a plastic material and a metal layer is disposed about said plastic material.

5. The invention of claim 1, further comprising a fastening means to fasten together said toothed rim and said outer housing.

6. The invention of claim 5, wherein said fastening means is an adhesive disposed between said toothed rim and said outer housing.

* * * * *